US008562168B2

(12) United States Patent
Napoli et al.

(10) Patent No.: US 8,562,168 B2
(45) Date of Patent: Oct. 22, 2013

(54) PERIMETER LIGHTING FIXTURE WITH WALL TRIM PIECE

(75) Inventors: Joseph David Napoli, San Dimas, CA (US); Jose' Luis Adame, San Dimas, CA (US)

(73) Assignee: Gammalux Systems, Inc., San Dimas, CA (US)

( * ) Notice: Subject to any disclaimer, the term of this patent is extended or adjusted under 35 U.S.C. 154(b) by 314 days.

(21) Appl. No.: 12/912,482

(22) Filed: Oct. 26, 2010

(65) Prior Publication Data

US 2012/0099300 A1 Apr. 26, 2012

(51) Int. Cl.
*F21S 8/00* (2006.01)

(52) U.S. Cl.
USPC ..... 362/147; 362/576; 362/150; 362/479; 362/490

(58) Field of Classification Search
USPC ..... 362/147, 148, 150, 576, 432, 404, 406, 362/145, 151, 152, 153, 479, 490
See application file for complete search history.

(56) References Cited

U.S. PATENT DOCUMENTS

| | | | | | |
|---|---|---|---|---|---|
| 1,780,125 | A | * | 10/1930 | Goodhouse | 362/280 |
| 1,955,935 | A | * | 4/1934 | Schepmoes | 362/147 |
| 4,748,543 | A | * | 5/1988 | Swarens | 362/147 |
| 5,226,724 | A | * | 7/1993 | Kanarek | 362/260 |

* cited by examiner

*Primary Examiner* — Evan Dzierzynski
*Assistant Examiner* — Danielle Allen
(74) *Attorney, Agent, or Firm* — Kenneth H. Ohriner; Perkins Coie LLP

(57) ABSTRACT

A perimeter lighting fixture has housing and a separate trim piece. The trim piece is attached to a wall. A wall compound, such as plaster, is smoothed over a blend area or band on the wall just below the trim piece, and also onto a transition section of the trim piece. The housing and/or a reflector of the perimeter lighting fixture is positioned in contact with the trim piece. The trim piece compensates for waviness or uneven wall surfaces. As the trim piece is straight, the variances in wall straightness are corrected. This allows the lighting fixture to be placed against or closely adjacent to the wall, without creating unsightly dark gaps between them, and without highlighting the imperfections in the wall.

20 Claims, 6 Drawing Sheets

PERIMETER LIGHTING FIXTURE WITH WALL TRIM PIECE

BACKGROUND OF THE INVENTION

Perimeter lighting fixtures are designed to be recessed into the ceiling along the perimeter of a room and distribute light down the wall and into the room. The light fixture housing is straight. However, the walls are often not straight or flat. To avoid an uneven and unsightly gap between the light fixture housing and the wall, the perimeter lighting fixture housing is typically spaced away from the wall, anywhere from ¼ to 1 inch. Perimeter lighting fixtures may also be fitted with an in-out adjustment, to keep the fixture housing or reflector assembly spaced apart from the wall, notwithstanding wall waviness or an irregular wall surface,. These attempts to visually conceal wall waviness have met with varying degrees of success. In virtually all cases however, an unsightly dark gap remains between the fixture housing and the wall. In some cases, notwithstanding the spacing between them, the straight edge of the fixture housing may also tend to highlight the waviness of the wall.

SUMMARY OF THE INVENTION

A new perimeter lighting fixture and installation method have now been invented which overcomes the problems in existing perimeter lighting fixtures as discussed above. In a first aspect, a perimeter lighting fixture has a housing and a separate trim piece. The trim piece is attached to a wall. A wall compound, such as plaster, is smoothed over a blend area or band on the wall just below the trim piece, and also onto a transition section of the trim piece. The housing and/or a reflector of the perimeter lighting fixture is positioned in contact with the trim piece. The installed trim piece compensates for waviness or uneven wall surfaces. As the trim piece is straight, the variances in wall straightness are corrected. This allows the lighting fixture to be placed against or closely adjacent to the wall, without creating unsightly dark gaps between them, and without highlighting imperfections in the wall.

BRIEF DESCRIPTION OF THE DRAWINGS

In the drawings, the same reference number indicates the same element in each of the views.

DETAILED DESCRIPTION OF THE DRAWINGS

Figure 1:
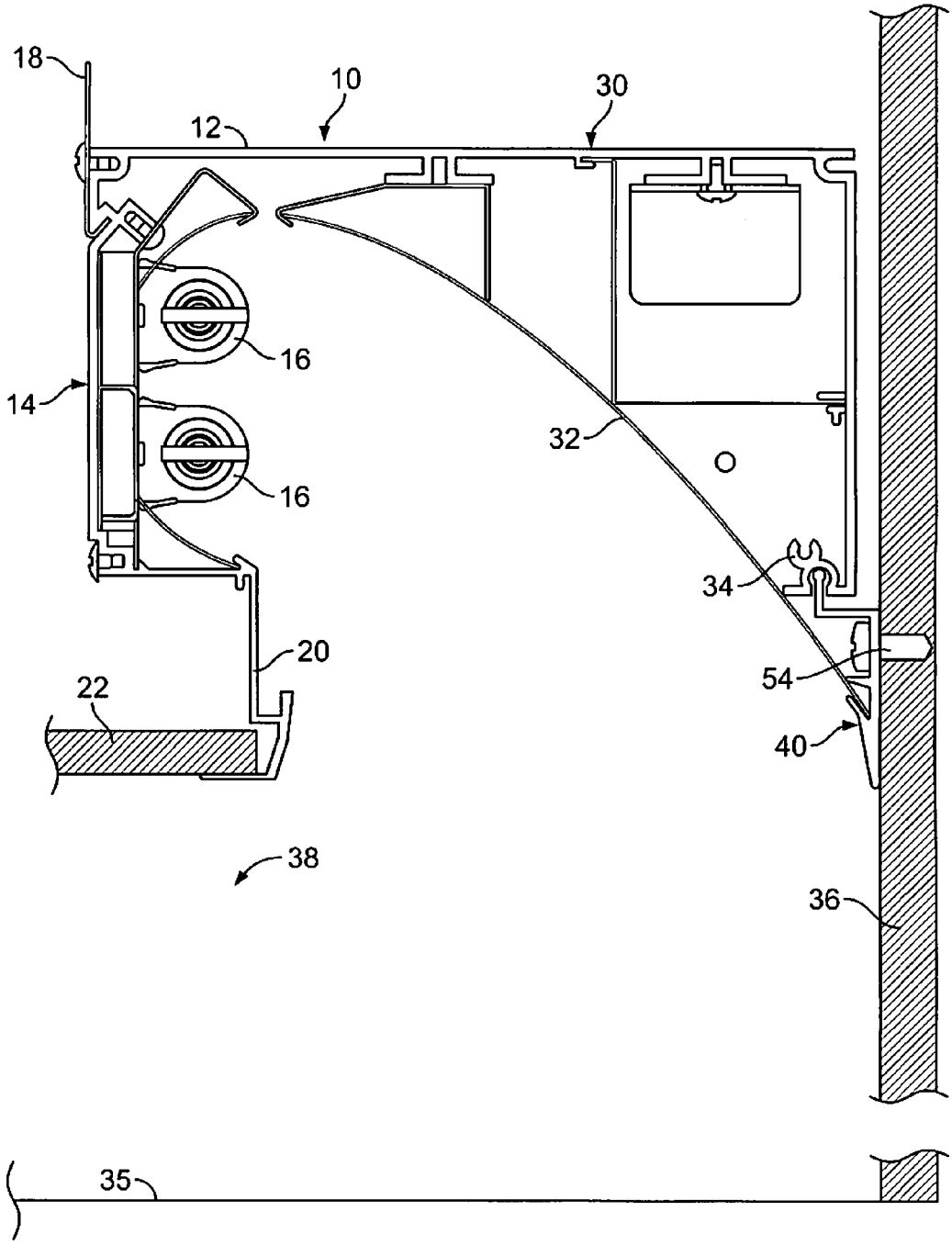
FIG. 1 is a partial section view of a perimeter lighting fixture installation using the new trim piece.

As shown in FIG. 1, a lighting fixture 10 includes a housing 12. The housing 12 may be formed via a metal extrusion. One or more lamp holders 16 may be provided in a lamp section 14 of the housing 12, with a reflector 32 in a reflector section 30 of the housing 12. The housing typically includes a ceiling arm 20 or other fitting for engaging and/or supporting ceiling panels or tiles 22. Hanger straps 18 suspended from an overhead structure may be attached to the housing 12, to support the lighting fixture 10.

Figure 2:
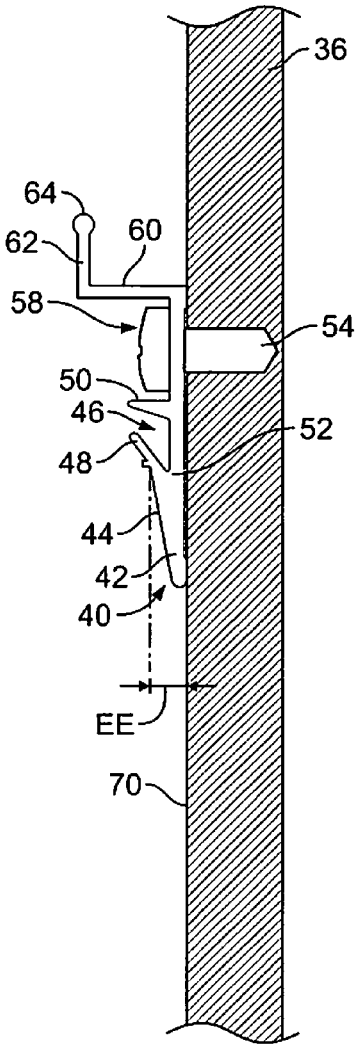
FIG. 2 is an enlarged section view of the trim piece shown in FIG. 1 installed on a wall, before plastering.

Turning to FIG. 2, a trim piece or strip 40 has a transition section 42, which may be in the form of a ramp, a concave or convex slope, or a staircase. The transition section may optionally include teeth, knurling, ridges or a similar textured surface 44. A reflector groove or slot 46 may be formed between an edge 48 and a lip 50. A fastener slot may be formed between the lip 50 and an angle section 60. Horizontally spaced apart screws or other fasteners 54 pass through clearance holes in the trim piece 40 and into the wall 36 of a room 38. As shown in FIG. 2, the trim piece 40 is mounted horizontally onto the wall 36. Adhesive strips may optionally be used in place of, or in addition to, the fasteners 54. The trim piece 40 typically has a generally flat back surface or base 52 held against the wall, with the transition section 42, the lip 50 and the angle section 60 joined to the base 52. In the example shown, a fixture arm 62 having a rounded or cylindrical end 64 is attached to the angle section 60. The trim piece 40 may be formed as a metal or plastic extrusion.

Figure 3:
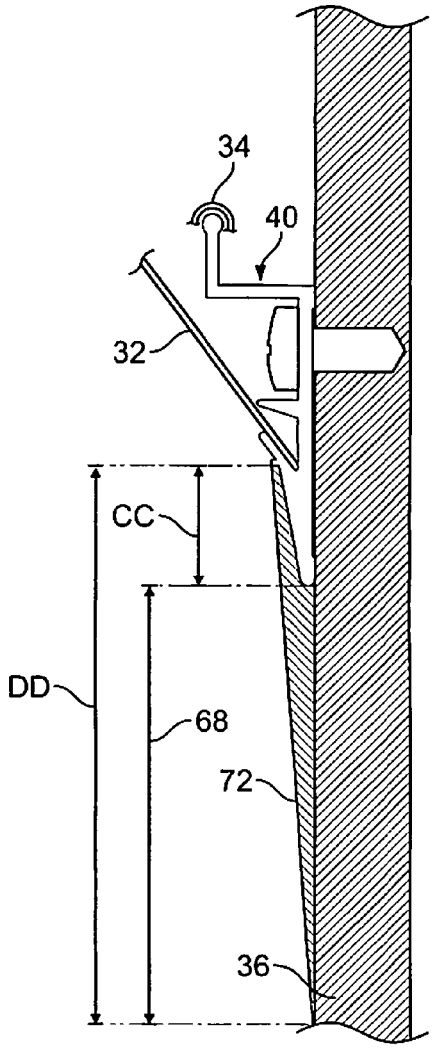
FIG. 3 is an enlarged section view of the trim piece shown in FIG. 2 after plastering.

Referring now to FIG. 3, after the trim piece 40 is attached to the wall 36 as shown in FIG. 2, plaster or similar wall compound 72 is applied over part or all of the transition section 42 of the trim piece 40, and over the blend strip or area 68 of the wall just below the transition section 42. The wall compound 72 is preferably applied to form a uniform smooth transition surface from the front surface 70 of the wall 36 onto the transition surface 42. The textured surface or teeth 44, if used, help the wall compound 72 adhere to the trim piece 40. The wall compound 72 and optionally the trim piece 40 may then be painted to match the rest of the wall. The vertical dimension DD of the band of wall compound is generally about 2-10 times the length CC of the transition section 42. The height EE of the transition section 42, shown in FIG. 2, may be about 0.05 to 0.4 times the length CC of the transition section 42.

As shown in FIGS. 1 and 3, the lower edge of the reflector 32 may then be placed into the reflector slot 46. The housing 12 of the lighting fixture 10 may also be engaged with, or supported by, the trim piece 40. FIG. 1 shows a receptacle 34 on the housing placed over the cylindrical end 64 of the fixture arm 62. As also shown in FIGS. 1 and 3, the housing 12 is closing adjacent to the front surface 70 of the wall 36. The housing 12 may optionally even be in contact with the wall. The wall compound 72 and the trim piece 40 provide a visually aesthetic transition between the wall and the lighting fixture 10. No space is needed between the lighting fixture and the wall, and no unsightly dark gap is formed between them. Although the wall surface 70 may be wavy or uneven, these irregularities in the wall are not revealed by the lighting fixture 10. The straight edge of the housing 12 of the lighting fixture 10 faces and engages with the trim piece 40, which is also straight, so that there is no irregularity between them. Any irregularities in the wall surface 70 near the trim piece 40 are taken out via the wall compound 72.

The trim piece 40 may be uniformly continuous with the housing 12, or separate segments of trim piece 40 may be used where desired. For example, segments of the trim piece 40 may be used on especially wavy areas of a wall and omitted from flat areas of the wall. Alternatively, the trim piece 40 may be installed in advance on all wall areas that will be facing or adjacent to a lighting fixture 10. In some designs, the fixture arm 62 and end 64 may be omitted, with the housing 12 entirely supported on other elements, and not supported on, or in contact with, the trim piece 40. In these types of designs, only the reflector 32 contacts or engages into the trim piece 40. In addition, the screw slot 58 and the lip 50 are also not essential elements and may optionally also be omitted in some designs. Accordingly, in a basic form, the trim piece 40 may comprise simply a straight segment having a transition section and a surface or slot for receiving either the reflector 32, or an element of the housing 12, or both.

The trim piece may be a steel or extruded aluminum piece, and may be provided as an accessory with perimeter lighting fixtures. The trim piece compensates for the errors in wall construction, visually correcting variations in wall straightness. As the trim piece is straight, the variances in wall straightness are corrected. This allows the reflector assembly or lighting fixture housing to appear as though it is completely integrated into the construction of the wall, creating an installation aesthetically superior to existing designs.

Figure 4:
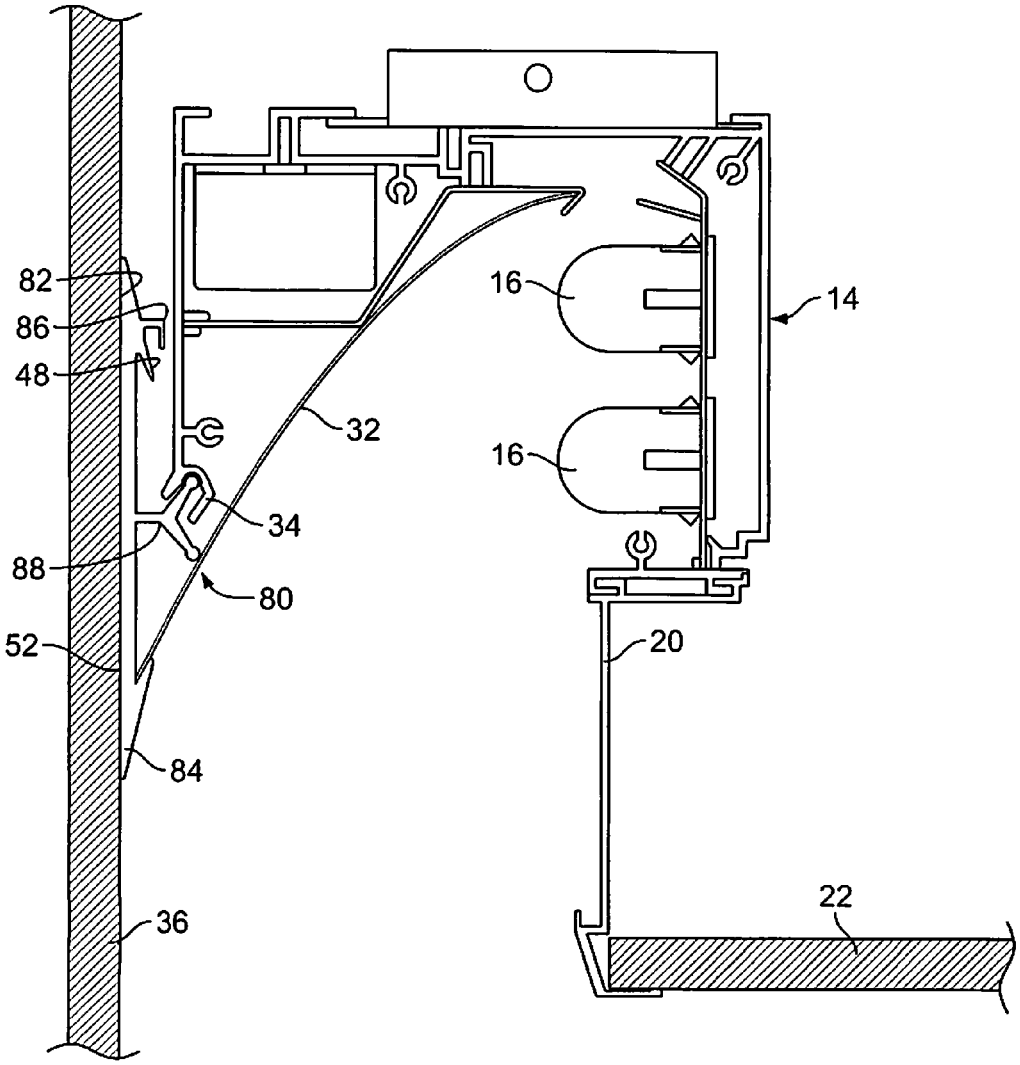
FIG. 4 is a partial section view of a second embodiment.
Figure 5:
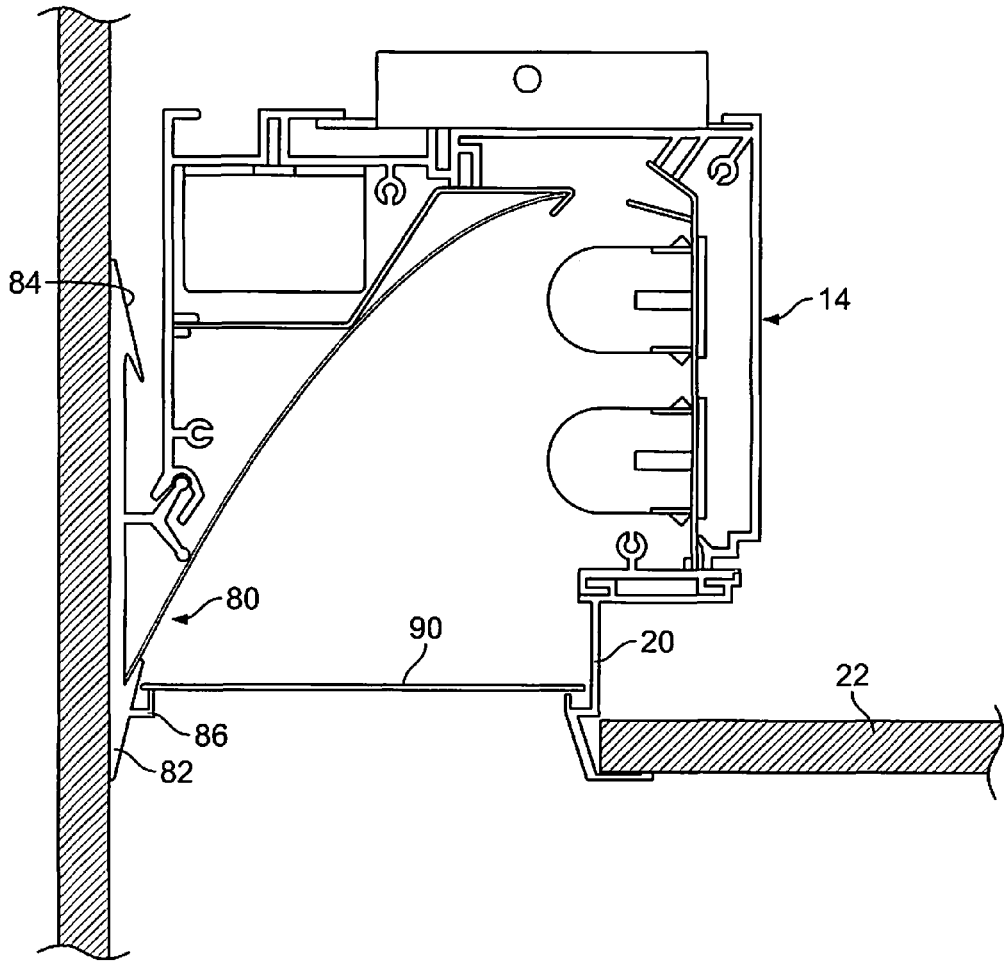
FIG. 5 is a partial section view showing an alternative use of the second embodiment shown in FIG. 4.

FIGS. 4 and 5 show an alternative reversible embodiment trim piece 80 having a first transition section 82 at one edge and a second transition section 84 at the opposite edge of the trim piece or strip. The first and second transition sections may have different profiles, or different shapes and sizes. The trim piece 80 has a holder arm 86 adjacent to the first transition section 82, which may be between a ramp edge 48, if present, and the first transition section 82. A web projection 88, which may be in the form of a "Y" or a "T" extends outwardly and optionally generally perpendicular to the base 52 of the trim piece 80. FIG. 4 shows the trim piece 80 installed with the first transition section 82 facing up.

In the design shown in FIGS. 4 and 5, the second transition section 84 performs in the same way as the transition section 42 discussed above relative to FIGS. 1-3. The trim piece 80 however may also be reversed and installed with the first transition section facing down, as shown in FIG. 5. This allows the installer to select the first or the second transition section for plastering or blending into the wall. In addition, as shown in FIG. 5, the trim piece 80 may be installed with the holder arm 86 in position to support a lens 90, or another component of a lighting fixture. The web projection 88 may have a first section or prong for supporting a receptacle 34 or other part of a lighting fixture, and optionally a second section or prong that supports or backs up a reflector 32, or other lighting fixture component.

Figure 6:
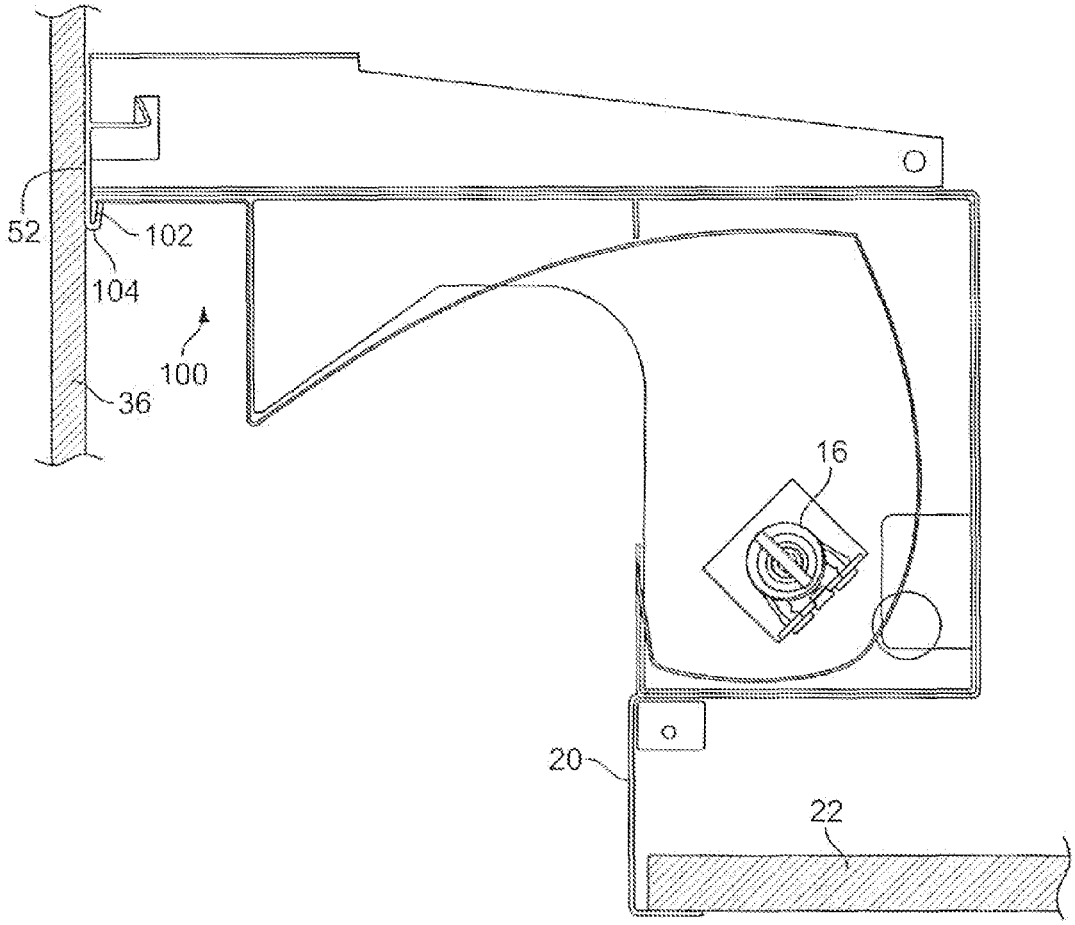
FIG. 6 is a partial section view of a third embodiment.
Figure 7:
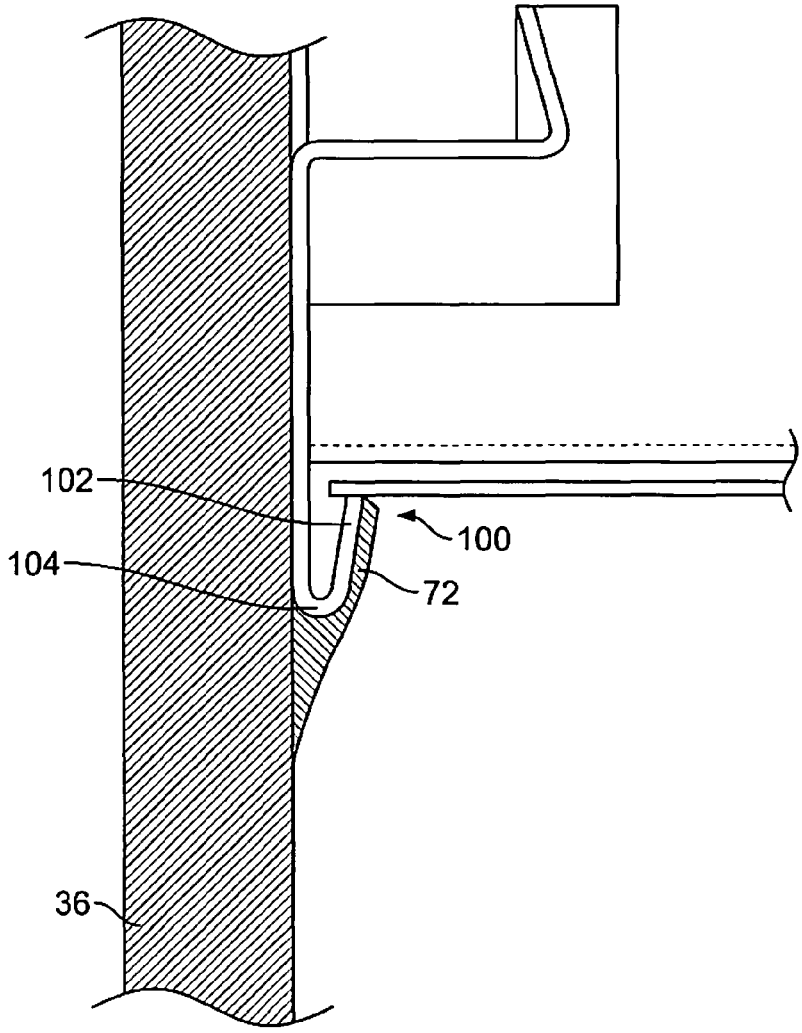
FIG. 7 is an enlarge detail view of installation of the third embodiment shown in FIG. 6.

FIGS. 6 and 7 show a third trim piece design 100, which may be an aluminum or a steel extrusion, having a lower lip or fold 102 joined to the base section 52 at a radius 104. The top surface of the lower lip 102 may support a component of a lighting fixture. As shown in FIG. 7, plaster or wall compound is applied over the lower lip 102, in a way similar to the transition section 42 described above, to smoothly blend the wall 36 with the lighting fixture.

Thus, a novel lighting fixture, trim strip and method of installation have been shown and described. Various changes and substitutions may be made without departing from the spirit and scope of the invention. The invention, therefore, should not be limited, except by the following claims and their equivalents.

The invention claimed is:

1. A perimeter lighting fixture comprising:

a housing having a first side and a second side;

a lamp holder adjacent to the first side of the housing;

a reflector extending substantially from the first side of the housing to the second side of the housing;

a trim piece, separate from the housing. and attachable to a vertical wall, and with the trim piece engaging at least one of the housing and the reflector.

2. The lighting fixture of claim 1 with the trim piece supporting the reflector and with the trim piece including a transition section, and further comprising a plastering wall compound on at least part of the transition section and on a blend area of the wall below the trim piece, and the reflector removable from the trim piece without affecting the plastering wall compound.

3. The lighting fixture of claim 1 further comprising a ceiling arm on the housing adapted to support a ceiling element.

4. The lighting fixture of claim 1 with the trim piece further comprising a lip and a reflector slot formed between the transition section and the lip, and with a lower edge of the reflector positioned in the reflector slot.

5. The lighting fixture of claim 1 with the trim piece further comprising a fixture arm on the trim strip in contact with the housing.

6. The lighting fixture of claim 5 further comprising a receptacle on the housing and with an end of the fixture arm engaged with the receptacle.

7. The lighting fixture of claim 1 further comprising a lip and an arm on the trim piece, and a fastener slot between the lip and the arm, with a plurality of spaced apart holes in the fastener slot.

8. The lighting fixture of claim 4 further comprising a fixture arm on the trim strip engaged into a receptacle on the housing.

9. The lighting fixture of claim 1 with the trim piece including a transition section in the form of a ramp.

10. The lighting fixture of claim 9 further comprising a textured surface on the ramp.

11. A lighting fixture comprising:

a housing;

a reflector in the housing;

a trim piece, separate from the housing, and attachable to a vertical wall;

the trim piece including a first transition section along a first edge and a second transition section along a second edge, opposite from the first edge, the first and the second transition sections each having an inner end thicker than an outer end: and a holder arm on the trim piece supporting the housing.

12. The lighting fixture of claim 11 with the first and second transition sections having different lengths.

13. The lighting fixture of claim 11 with the first and second transition sections having different shapes.

14. The lighting fixture of claim 11 with the first and second transition sections comprising ramps.

15. The lighting fixture of claim 11 further comprising a plasterng wall compound on at least part of the first or the second transition section and on a blend area of the wall below the trim piece.

16. A method for installing a perimeter lighting fixture, comprising:

attaching a trim piece to a wall, with the trim piece having a transition section and a support;

applying a plastering wall compound into a blend area of the wail below the rim piece and onto the transition section; and placing a part of the lighting fixture into contact with the support, with the trim piece separate from the lighting fixture, and with the part of the lighting fixture placed into contact with the lighting fixture also removable from the support without affecting the plastering wall compound.

17. The lighting fixture of claim 16 With the part of the lighting fixture placed into contact with the lighting fixture comprising a reflector of the lighting fixture.

18. The lighting fixture of claim 16 with the part of the lighting fixture placed into contact with the lighting fixture comprising a part of a housing of the lighting fixture.

19. The lighting fixture of claim 16 with the part of the housing comprising a receptacle.

20. The lighting fixture of claim 16 further comprising placing a lower edge of the reflector into a slot in the trim piece.

* * * * *